US007056384B2

(12) United States Patent
Davis et al.

(10) Patent No.: US 7,056,384 B2
(45) Date of Patent: Jun. 6, 2006

(54) STRIP BRUSH BOWLING LANE DRESSING APPLICATION MECHANISM

(75) Inventors: Mark E. Davis, Sebring, FL (US); Anthony Crews, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 149 days.

(21) Appl. No.: 10/791,413

(22) Filed: Mar. 2, 2004

(65) Prior Publication Data

US 2005/0196544 A1 Sep. 8, 2005

(51) Int. Cl.
*B05C 1/06* (2006.01)

(52) U.S. Cl. ..... 118/207; 118/244; 118/261; 15/50.3; 15/52; 15/52.1; 15/98; 15/103.5

(58) Field of Classification Search ..... 118/207, 118/244, 261; 427/429; 15/50.3, 52, 52.1, 15/98, 103.5, 256.51
See application file for complete search history.

(56) References Cited

U.S. PATENT DOCUMENTS 2,324,652 A * 7/1943 Stoker ..... 204/206
2,660,791 A * 12/1953 Howell et al. ..... 33/41.6
3,302,234 A * 2/1967 Moss et al. ..... 15/256.51
4,766,016 A * 8/1988 Kubo ..... 427/428.18
4,980,815 A * 12/1990 Davis ..... 700/11
5,566,420 A * 10/1996 Specht ..... 15/256.5
5,935,333 A 8/1999 Davis
6,383,290 B1 5/2002 Davis et al.

* cited by examiner

*Primary Examiner*—Laura Edwards
(74) *Attorney, Agent, or Firm*—Hovey Williams LLP

(57) ABSTRACT

A bowling lane conditioning machine has dressing application mechanism that includes an elongated, non-rotating strip brush which transfers dressing from a dispensing means to another surface, such as a bristle-type, lane-engaging applicator roll, a metal transfer roll that in turn transfers the dressing to the applicator roll, or the lane surface itself. In a preferred embodiment, dressing is dispensed to an upper one of two strip brushes that extend along the length of an applicator roll and engage its bristles at circumferentially spaced locations around its periphery. Dressing dispensed to the upper strip brush migrates by gravity to the bristles of the applicator roll and becomes applied to the lane surface as the roll rotates down into engagement with the surface. No dressing is dispensed to the second strip brush, which feathers the dressing on the applicator roll and reduces splattering.

22 Claims, 3 Drawing Sheets

STRIP BRUSH BOWLING LANE DRESSING APPLICATION MECHANISM

TECHNICAL FIELD

The present invention relates to bowling lane maintenance machines that apply lane dressing, such as oil, to the surface of a bowling lane and, more particularly, to improvements in the dressing application mechanism of such machines.

BACKGROUND AND SUMMARY

In the prior art dressing is typically delivered to the lane surface using a bristle-type applicator roll that receives its dressing from wick-like pads or a reciprocating dispensing head. In both cases the dressing is usually initially applied by the pads or dispensing head to an intermediate metal transfer roll which, in turn, engages and transfers dressing to the applicator roll. In some constructions additional smoothing rollers or non-rotating smoothing pads engage the surface of the transfer roll before it transfers dressing to the applicator roll.

The present invention contemplates a simplified delivery system that can eliminate a significant amount of the transfer mechanism used in the prior art. In one preferred embodiment of the invention, dressing from a source such as a moving dispensing head is delivered to a non-rotating brush assembly that, in turn, directly engages the applicator roll and transfers dressing thereto. Preferably, the brush assembly includes at least one strip brush that extends along the length of the applicator roll and has its relatively dense body of bristles interengaging the bristles of the applicator roll. The strip brush is so configured and arranged that when dressing is supplied to the brush, the dressing gravitates along its bristles and onto the bristles of the rotating applicator roll.

Preferably, dressing is supplied to the strip brush by a single dispensing head that reciprocates back and forth across the machine in a known manner. In a preferred form of the invention, a second strip brush spaced circumferentially downstream from the first strip brush with respect to the direction of rotation of the applicator roll also has its bristles directly interengaging the bristles of the applicator roll to assist in distributing the dressing to the applicator roll, but the second or supplemental brush receives no dressing from the dispensing head. The bristles of both brushes are preferably constructed from a synthetic resinous material.

In another aspect of the invention, the non-rotating brush assembly can be used to apply dressing directly to the lane surface, without using an intermediate applicator roll. Another variation is to use the brush assembly to apply dressing to a metal transfer roll, which in turn transfers the dressing to an applicator roll in the usual manner.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
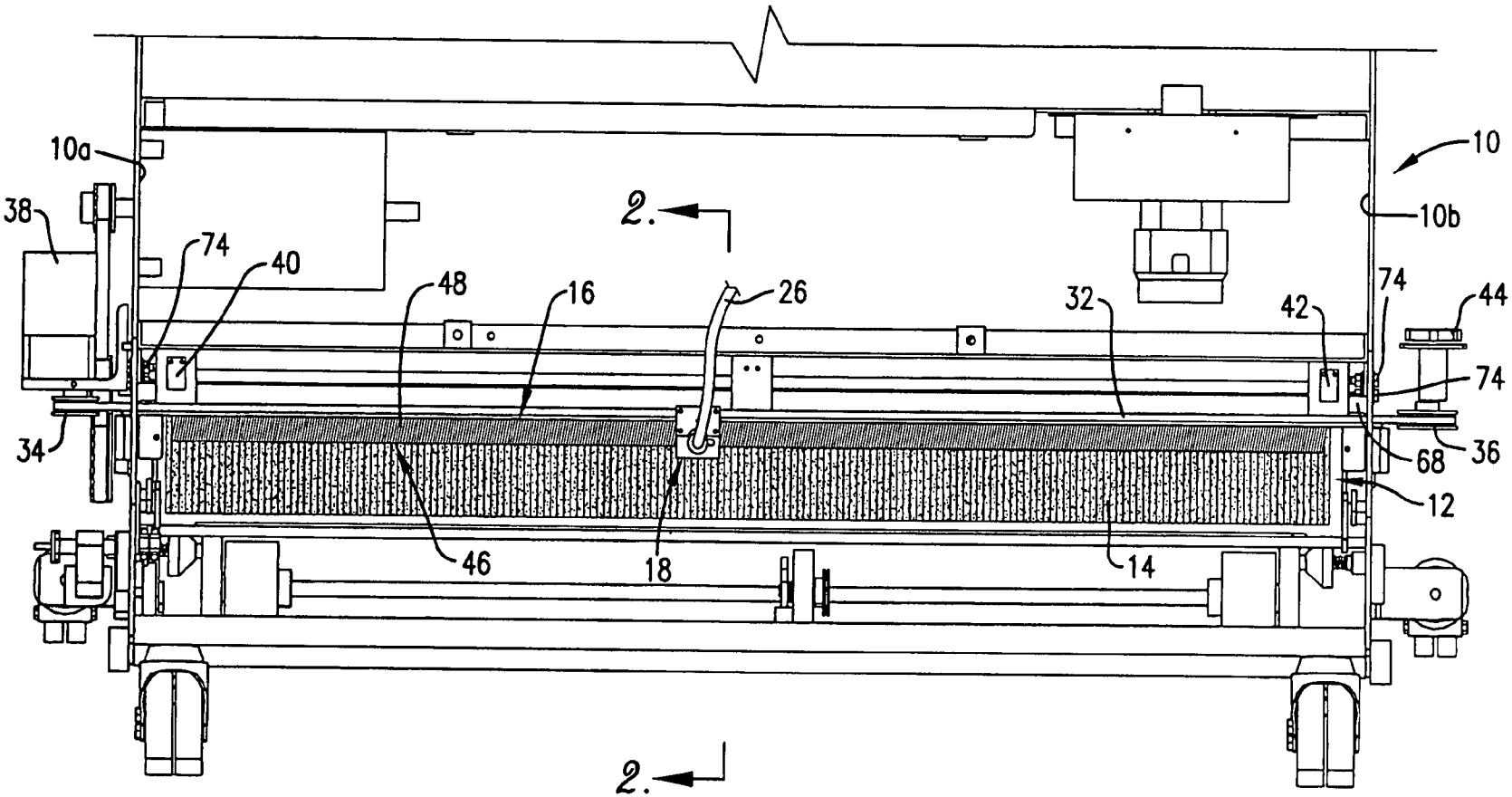
FIG. 1 is fragmentary top plan view of one embodiment of a lane maintenance machine incorporating dressing application mechanism in accordance with a preferred form of the present invention, the cover of the machine being removed to reveal internal details of construction.

The lane conditioning machine 10 in FIG. 1 is similar in many respects to the machine disclosed in U.S. Pat. No. 5,729,855. Therefore, the '855 patent is hereby incorporated by reference into the present specification. In view of the full disclosure in the '855 patent of the nature and operation of the lane machine, many constructional details of machine 10 will not be repeated herein.

Figure 2:
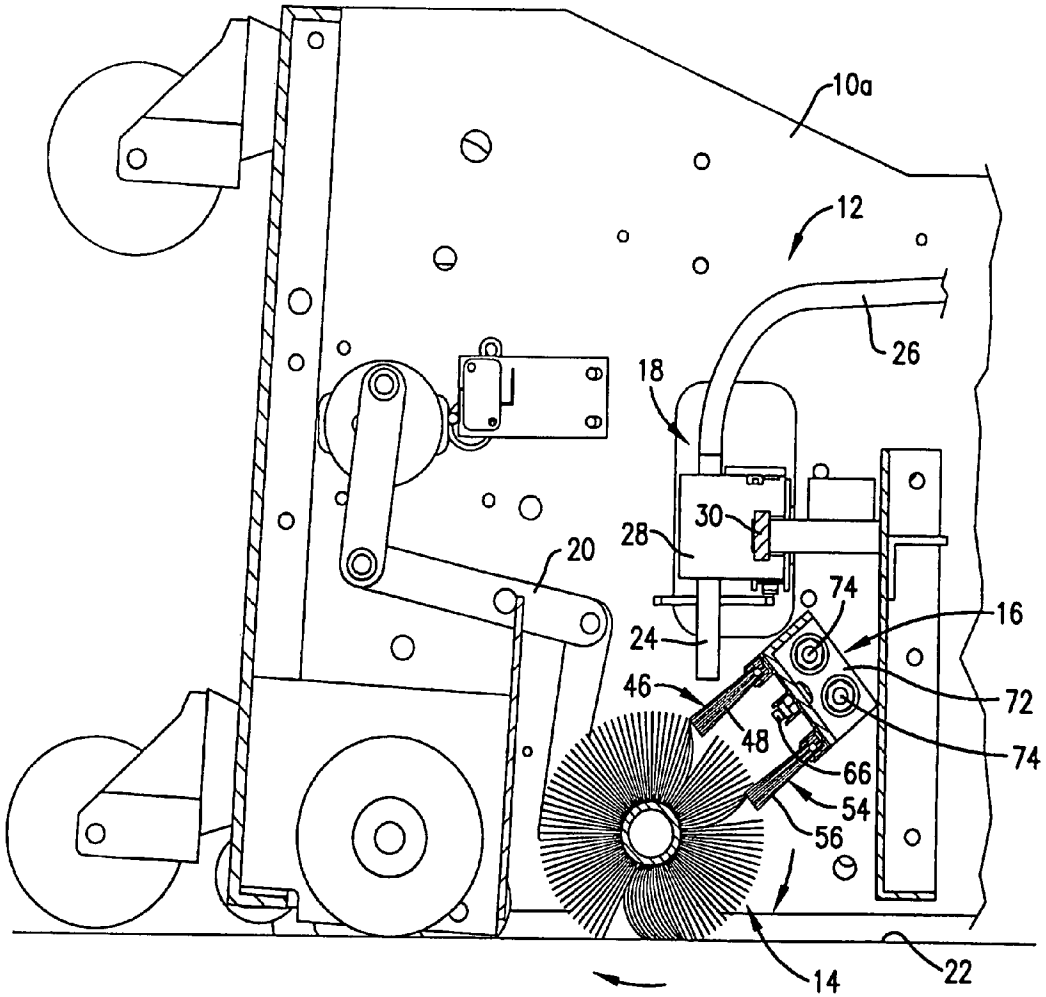
FIG. 2 is an enlarged, fragmentary, vertical cross-sectional view through the machine taken substantially along line 2—2 of FIG. 1.

The present invention is directed to improvements in the dressing application mechanism broadly denoted by the numeral 12. In one preferred form of the invention, such mechanism 12 includes an applicator roll 14, a non-rotating brush assembly 16, and a dressing dispensing head 18. As well understood by those skilled in the art, applicator roll 14 preferably comprises a bristle-type roll having bristles that are fabricated from a synthetic resinous material. A suitable roll in this respect is available, for example, from IBC International Brush Corporation of Lakeland, Fla. Applicator roll 14 is supported by a linkage 20 for movement between a lowered, lane-contacting position as shown in the drawings and a raised, out-of-contact position (not shown). Roll 14 is driven in a clockwise direction in FIG. 2 as machine 10 moves up and down the lane with roll 14 in contact with lane surface 22.

Dispensing head 18 includes an upright, tubular nozzle 24 that is connected via a supply hose 26 with a source of lane dressing (not shown), including a digitally controlled metering pump and a reservoir. A block-like holder 28 carries nozzle 24. Head 18 is mounted on a transversely extending, horizontal guide track 30 that extends across the full width of the machine above and parallel to applicator roll 14, and an endless belt 32 (FIG. 1) is operably coupled with head 18 for shifting the latter back and forth along track 30. Belt 32 is entrained around a pair of pulleys 34 and 36 located outboard of opposite sidewalls 10*a* and 10*b* of the machine, the pulley 34 being driven by a reversible motor 38 that is controlled by a pair of proximity sensors 40 and 42 adjacent opposite ends of the path of travel of dispensing head 18. A notched timing wheel 44 associated with pulley 36 cooperates with sensors (not shown) to sense the rotation of timing wheel 44 and thus sense the position of head 18 along its path of travel for use in controlling the dressing pattern applied to lane surface 22.

Motor 38 thus drives head 18 back and forth across the machine generally along the length of applicator roll 14 at a constant speed, except for deceleration and acceleration at opposite ends of the path of travel. As dispensing head 18 moves along its path of travel, it intermittently discharges streams of dressing through nozzle 24 in accordance with a predetermined dressing pattern controlled by the control system (not shown) of the machine. Depending upon the pattern selected by the user, the head 18 may or may not be dispensing dressing at any particular point along its path of travel.

Brush assembly 16 is disposed to intercept dressing dispensed from nozzle 24 and to transfer it to applicator roll 14. Assembly 16 includes at least one strip brush 46 having a dense body of bristles 48 that extends along the full length of applicator roll 14 directly below and in vertical alignment with the path of travel of dispensing nozzle 24. Bristles 48 approach applicator roll 14 at an inclined angle to engage bristles of roll 14 in an upper portion thereof at approximately a one o'clock position. Preferably, bristles 48 approach applicator roll 14 at an approximately 45 degree angle so that the force of gravity is utilized to assist in transferring dressing from bristles 48 to the bristles of applicator roll 14.

In a preferred embodiment, bristles 48 are constructed from a synthetic resinous material such as, for example, nylon 612. In this respect it is desirable for bristles 48 to have a low rate of absorption so that the dressing travels along bristles 48 to applicator roll 14 rather than migrating into the interior of such bristles. A low absorption rate also prevents the bristles from swelling. Preferably, bristles 48 have a diameter ranging from approximately 0.003 inches to approximately 0.020 inches and have an exposed length of approximately 1.25 inches. A preferred density of the body of bristles is approximately 3.25 grams of fiber per lineal inch of the brush. In a preferred form of the invention the body of bristles 48 is constructed from many individual tufts of fibers that are looped around a common binding wire 50 extending the full length of brush 46. A generally U-shaped crimped channel 52 also extends the full length of the brush and receives the bight portion of the individual tufts to retain the tufts in place. One source for a suitable strip brush of this type is IBC Industrial Brush Corporation of Lakeland, Fla.

In a most preferred form of the invention, brush assembly 16 further includes a second strip brush 54 that is spaced circumferentially around applicator roll 14 from the first brush 46. More particularly, brush 54 is located between brush 46 and lane surface 22 so that it is not in a position to receive dressing from dispensing nozzle 24. Instead, the function of strip brush 54 is to feather out the dressing on the roll 14 and prevent it from splattering as the roll 14 rotates. Preferably, bristles 56 of lower strip brush 54 are interengaged with the bristles of applicator roll 14 in generally the same manner as bristles 48 of upper strip brush 46. In one preferred form, lower strip brush 54 is constructed identically to upper strip brush 46.

Brush assembly 16 further includes a backing plate 58 to which strip brushes 46 and 54 are both secured. Plate 58 extends the full length of strip brushes 46, 54 and is provided on its backside with three longitudinally extending, laterally spaced receiving channels 60, 62 and 64 that extend the full length of plate 58. Receiving channels 60 and 64 are of such size and shape that they tightly receive and retain the crimped channel 52 associated with brushes 46 and 54 to prevent accidental dislodgement of brushes 46, 54 from plate 58. The central receiving channel 62 is empty, except for the presence of several fastening screws 66 along its length as explained below.

Brush assembly 16 additionally includes a main support bar 68 that spans the full width of machine 10 and serves as the means by which brush assembly 16 is supported within the machine. Support bar 68 has a back wall 70 having a lower rear surface to which mounting plate 58 is secured by the fastening screws 66. Opposite ends walls 72 of support bar 68 are butted up against corresponding machine sidewalls 10*a* and 10*b* and are secured thereto by a pair of fastening bolt assemblies 74.

Figure 4:
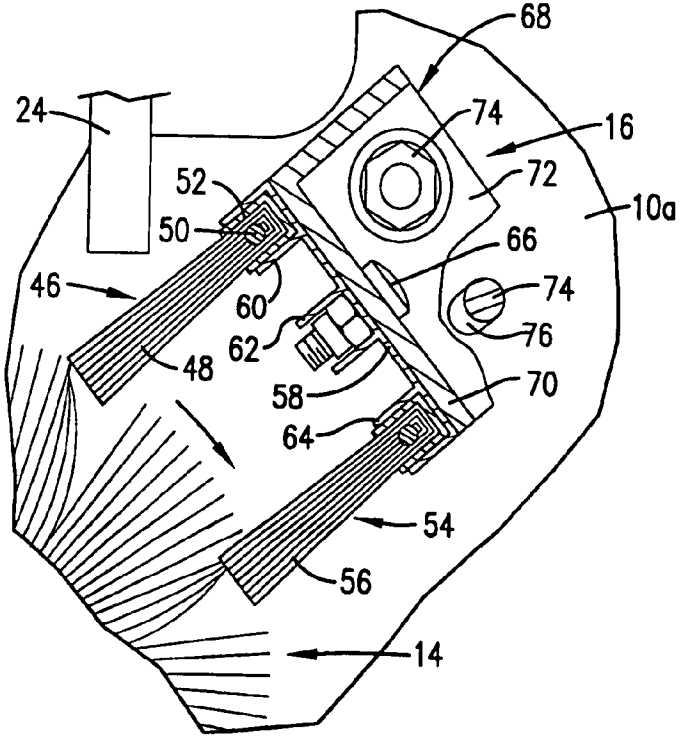
FIG. 4 is an enlarged fragmentary cross-sectional view of the mechanism similar to FIG. 2 but with portions of the support bar of the brush assembly broken away to reveal adjustable mounting details.
Figure 3:
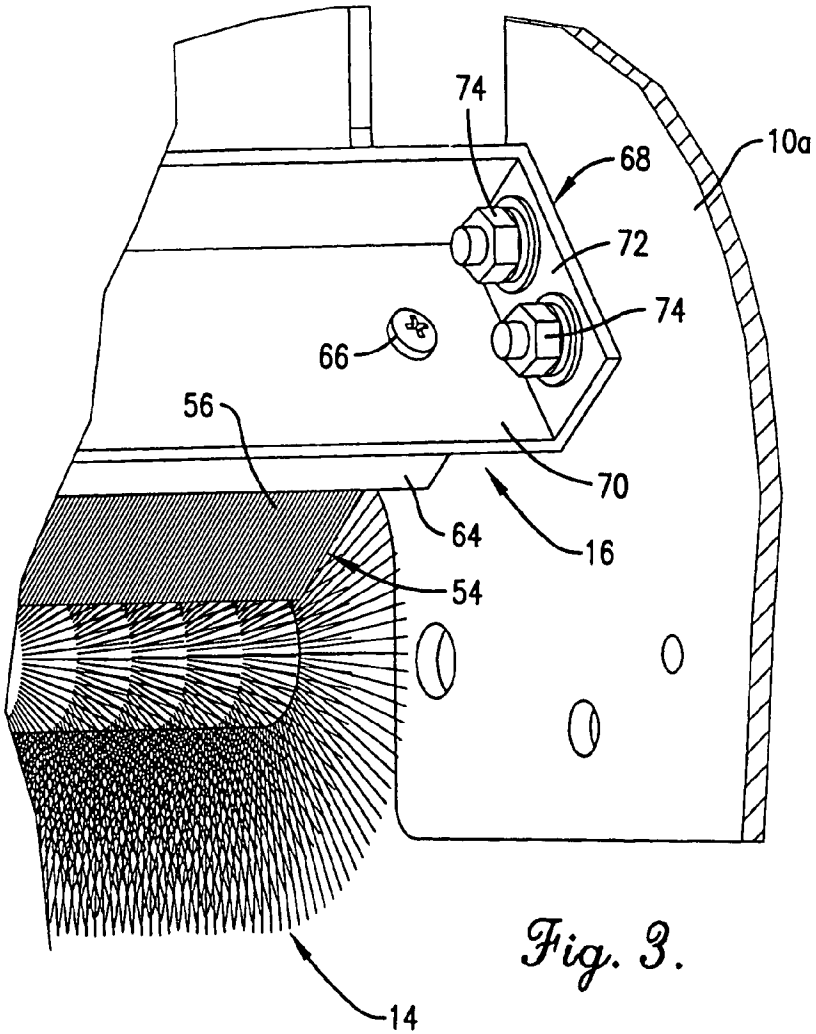
FIG. 3 is a further enlarged, fragmentary isometric view of the mounting arrangement for the brush assembly looking upwardly and rearwardly from a position slightly in front of and below the support bar of the brush assembly.

As illustrated in FIG. 4 with respect to machine sidewall 10*a*, the two sidewalls 10*a*, 10*b* are slotted to receive bolt assemblies 74. Such slots 76 are elongated in a direction extending generally radially with respect to the axis of rotation of applicator roll 14. Thus, when bolt assemblies 74 are sufficiently loosened, brush assembly 16 may be adjustably shifted toward or away from applicator roll 14 to adjust the extent to which strip brushes 46, 54 project into the bristles of applicator roll 14, such depth of interengagement being hereinafter referred to as the "crush" of brushes 46, 54 into roll 14. Experience has taught that the greater the crush of strip brushes 46, 54 into applicator roll 14, the quicker the dressing gets applied to the lane surface 22 from nozzle 24.

OPERATION

The manner of use and operation of the dressing application mechanism 12 should be apparent from the foregoing description. Therefore, such operation will be only briefly summarized at this point.

As machine 10 travels down the lane, the dispensing head 18 travels back and forth along its guide track 30 on a continuous basis and at a constant rate of speed, except at the opposite ends of its path of travel where it decelerates and reverses directions. Depending upon the conditioning pattern selected by the user and the location of the machine down the lane, dressing may or may not issue from nozzle 24 at a given point along track 30. During successive trips back and forth, dispensing head 18 repeats the discharge of dressing in certain areas but not others so as to buildup the chosen pattern.

As the dressing issues from moving nozzle 24, it is intercepted by the body of bristles 48 of upper strip brush 46. Such dressing then flows by gravity down the length of bristles 48 and into engagement with the bristles of applicator roll 14. The length of time between initial engagement of the dressing with bristle 48 and the transfer of the dressing to roll 14 depends in large measure upon the crush of bristles 48 into applicator roll 14, as well as the viscosity of the dressing. The dressing received by the bristles applicator roll 14 then becomes applied to lane surface 22 as roll 14 rotates down into engagement with such surface.

Although a second strip brush 54 is not absolutely necessary, it has been found than better results are obtained when such additional brush is present. Less splattering seems to occur and a more even distribution of the desired lane pattern appears to result.

It is also contemplated that brush assembly 16 may be utilized in other ways than transferring dressing to applicator roll 14. For example, in appropriate situations, it may be possible to eliminate applicator roll 14 altogether and to apply dressing directly to the lane from brush assembly 16. Only a single strip brush would most likely be used in that instance. Alternatively, the brush assembly 16 might be used to transfer dressing to a metal transfer roller which in turn would transfer dressing to an applicator roll.

It is also within the scope of the present invention to provide one or both of the strip brushes 46 and 54 with different zones of bristle characteristics along the length thereof, instead of having bristles of uniform characteristics along the full length of the brush. For example, one zone could contain bristles constructed from nylon 612, while another could contain bristles constructed from horse hair, or another material. Further, the diameters of the bristles in different zones could be varied, and the density of the tufts of bristles could be different from one zone to the next. This would have the effect of varying the dressing transfer properties of the brush along its length, which could in turn be coordinated with the desired lane dressing pattern.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following

The invention claimed is:

1. In a machine for applying dressing to a bowling lane, the improvement comprising:

a driven applicator roll operable to apply dressing to the surface of a lane as the machine travels along the lane; and a non-rotary brush assembly disposed in engagement with said applicator roll for transferring dressing received by the brush assembly to the applicator roll, said applicator roll having a plurality of generally radially outwardly projecting bristles, said brush assembly having bristles that are disposed in interengagement with the bristles of the applicator roll.

2. In a machine as claimed in claim 1, said brush assembly having bristles that project downwardly toward the applicator roll such that the force of gravity assists the brush assembly in delivering dressing to the applicator roll.

3. In a machine as claimed in claim 2, said bristles of the brush assembly being disposed at an inclined angle.

4. In a machine as claimed in claim 3, the angle of inclination of the bristles being approximately 45°.

5. In a machine as claimed in claim 3, said brush assembly engaging the applicator roll in an upper portion of the roll.

6. In a machine as claimed in claim 2, said bristles being constructed from a synthetic resinous material.

7. In a machine as claimed in claim 1, further comprising a dressing dispensing head movable along a path of travel generally parallel to the axis of rotation of the applicator roll and disposed to dispense dressing to the brush assembly during such movement.

8. In a machine as claimed in claim 1, said brush assembly being adjustably shiftable toward and away from the applicator roll.

9. In a machine as claimed in claim 1, said brush assembly comprising a pair of strip brushes extending generally parallel to the axis of rotation of the applicator roll and spaced circumferentially from one another around the applicator roll.

10. In a machine as claimed in claim 9, further comprising a dressing dispenser disposed to dispense dressing to one of said strip brushes, the other strip brush being spaced from the dressing dispenser.

11. In a machine as claimed in claim 10, said other strip brush being disposed to engage the applicator roll at a point between said one strip brush and the lane surface.

12. In a machine as claimed in claim 11, said strip brushes engaging the applicator roll in an upper portion of the roll.

13. In a machine as claimed in claim 10, said strip brushes having bristles that project downwardly toward the applicator roll such that the force of gravity assists said one strip brush in delivering dressing to the applicator roll.

14. In a machine as claimed in claim 13, said bristles of the strip brushes being disposed at an inclined angle.

15. In a machine as claimed in claim 14, the angle of inclination of the bristles being approximately 45°.

16. In a machine as claimed in claim 9, said strip brushes having bristles constructed from a synthetic resinous material.

17. In a machine as claimed in claim 1, said brush assembly having bristles constructed from a synthetic resinous material.

18. In a machine for applying dressing to the surface of a bowling lane, an improved dressing transfer mechanism comprising:

a non-rotary brush assembly including an elongated, generally horizontally extending strip brush; and a dressing dispenser disposed to supply dressing to the strip brush for subsequent redistribution, said strip brush including a set of downwardly projecting, inclined bristles presenting an inclined upper side, said dispenser comprising a dispensing head movable along a nath of travel extending generally parallel to and above the strip brush, said dispenser being disposed to discharge lane dressing onto the upper side of the bristles of the strip brush as the dispenser moves alone its nath of travel.

19. In a machine as claimed in claim 18, further comprising a driven applicator roll disposed in engagement with the lane surface and the strip brush for receiving dressing from the strip brush and applying it to the lane surface.

20. In a method of transferring dressing to a bowling lane, the improvement comprising:

providing a source of lane dressing;

dispensing lane dressing from the source onto a non-rotating brush assembly that includes at least one strip brush having bristles; and transferring dressing from the strip brush to a rotary applicator roll having bristles disposed in engagement with the lane and with the bristles of the strip brush for obtaining dressing from the strip brush and applying it to the lane.

21. In a method as claimed in claim 20, said dispensing step including dispensing the dressing from a dispenser that moves back and forth along the length of the strip brush.

22. In a method as claimed in claim 20, said transferring step including inclining the strip brush downwardly toward said applicator roll such that the force of gravity assist in transferring dressing from the strip brush to said applicator roll.

* * * * *